United States Patent [19]

Tardivel

[11] Patent Number: 4,513,461

[45] Date of Patent: Apr. 30, 1985

[54] SLEEPING BAG WITH REMOVABLE SHEET

[75] Inventor: Monique M. Tardivel, Sedona, Ariz.

[73] Assignee: Georges M. Tardivel, Venice, Calif.

[21] Appl. No.: 570,608

[22] Filed: Jan. 11, 1984

[51] Int. Cl.[3] ..... A47G 9/08

[52] U.S. Cl. ..... 5/413; 5/502; 2/69.5

[58] Field of Search ..... 5/413, 482, 485, 494, 5/502, 500; 2/69.5

[56] References Cited

U.S. PATENT DOCUMENTS

| | | | |
|---|---|---|---|
| 2,151,462 | 3/1939 | Bulpit et al. | 5/413 |
| 2,379,416 | 7/1945 | Clark | 5/413 |
| 2,972,757 | 2/1961 | Adrian | 5/413 |
| 3,178,734 | 4/1965 | Carrez | 5/413 |
| 3,530,487 | 9/1970 | Beer | 5/500 |
| 3,774,249 | 4/1973 | Ybarra et al. | 5/413 |
| 4,292,700 | 10/1981 | Markel | 5/498 |
| 4,339,835 | 7/1982 | Jaffe et al. | 5/485 |

*Primary Examiner*—Alexander Grosz

*Attorney, Agent, or Firm*—Harvey B. Jacobson

[57] ABSTRACT

A first outer panel foldable upon itself to form opposing panel portions is provided with each panel portion defining corresponding first and second transverse edges and first and second longitudinal edges. The second longitudinal edges are integrally joined by the portion of the panel to be folded and first slide fastener equipped flaps extend along the second transverse edge and the first longitudinal edges. A second centrally foldable inner insulation panel of generally the same size and shape as the outer panel is also provided and overlies the inner side of the outer panel. Coacting pressure sensitive attaching structure extends along the first longitudinal edges and the second transverse edge of the first and second panels and removably joins the insulation panel to the outer panel. A third sheet panel of generally the same size and shape as the first and second panels is also provided and the flaps of the first panel and the corresponding edges of the third panel include coacting second slide fastener structure extending therealong removably joining the third panel to the flaps of the first panel. The third panel is of a greater length than the first panel and defines at the first transverse edges thereof outward projecting flap structure foldable outwardly over the side of the first transverse edges of the first panel remote from the second panel and fastener structure is carried by the flap structure and the opposing portion of the first panel removably securing the flap structure in position.

9 Claims, 6 Drawing Figures

SLEEPING BAG WITH REMOVABLE SHEET

BACKGROUND OF THE INVENTION

Sleeping bags are convenient to use in many environments, but most sleeping bags do not include sheet or other type removable liners. Accordingly, if a person using a sleeping bag becomes overly warm and perspires, the entire sleeping bag must be washed. Of course, frequently washing of a sleeping bag is detrimental not only to the lightweight inner and outer panels of the sleeping bag but also to the insulative filler material used therein. Accordingly, a need exists for a sleeping bag including a removable sheet-type liner whereby the liner of the sleeping bag may be readily removed, washed and quickly dried when desired.

Various different forms of sleeping bags including some of the general structural and operational features of the invention are disclosed in U.S. Pat. Nos. 3,584,323, 3,839,756 and 3,857,125.

BRIEF DESCRIPTION OF THE INVENTION

The sleeping bag of the instant invention is constructed in a manner whereby a sheet-forming inner panel may be secured therein in a removable manner thereby enabling the inner panel to be removed and laundered or otherwise cleaned when necessary.

The sleeping bag also includes a removable insulation panel as well as the usual outer panel and, accordingly, any one of the three panels may be removed and washed or otherwise cleaned independent of cleaning the other two panels. Further, the three relatively removable panels enable replacement of either panel to be more readily carried out and the removable insulation panel enables removal of the insulation panel and replacement thereof by a similar insulation panel of a different weight. Therefore, the sleeping bag of the instant invention may be used not only in extremely cold weather but in milder weather, according to the weight of the insulation panel used. Further, the interior sheet forming panel may also be removed for laundering.

The main object of this invention is to provide a sleeping bag including a removable inner sheet liner whereby the inner liner may be removed and laundered when desired.

Another object of this invention is to provide a sleeping bag including not only a removable inner liner but also relatively separable insulation and outer panels thereby enabling an insulation panel of a given weight to be substituted for by another insulation panel of a different weight.

Yet another object of this invention is to provide a sleeping bag in accordance with the preceding objects and which may include an inner liner of cotton material such as that used in the construction of conventional bed sheets and which is thereby more comfortable to use.

A final object of this invention to be specifically enumerated herein is to provide a sleeping bag which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
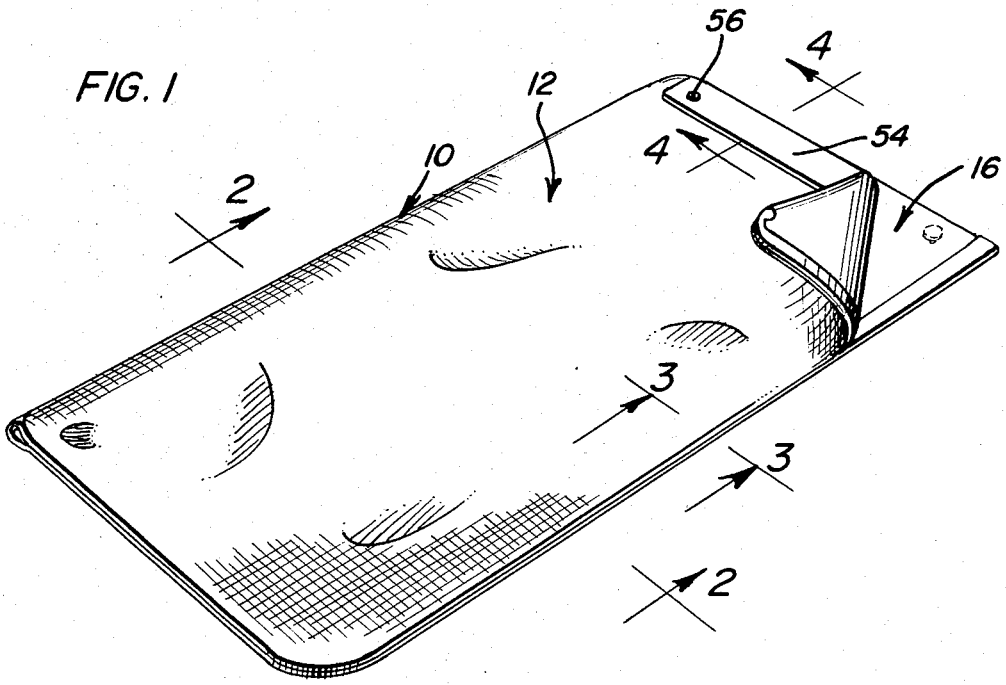
FIG. 1 is a perspective view of the sleeping bag of the instant invention.
Figure 2:
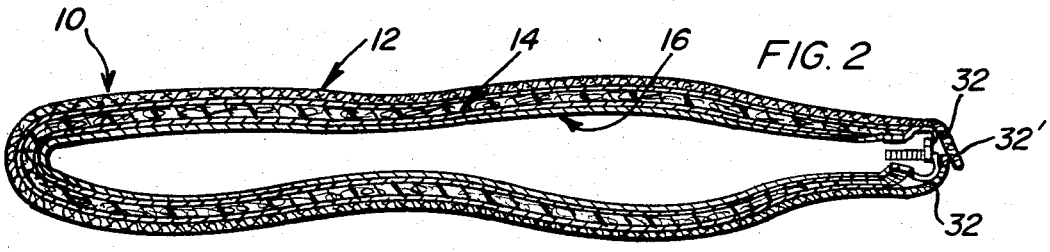
FIG. 2 is an enlarged transverse sectional view taken substantially upon the plane indicated by the section line 2—2 of FIG. 1.

Referring now more specifically to the drawings, the numeral 10 generally designates the sleeping bag of the instant invention. The sleeping flexible bag 10 includes a first outer panel referred to in general by the reference numeral 12, a second intermediate insulation panel referred to in general by the reference numeral 14 and an inner sheet forming panel referred to in general by the reference numeral 16.

The outer panel 12 includes a central fold line or zone 18 along which the outer panel 12 may be folded in order to form a bag-type receptable for a human body and the fold line divides the panel 12 into a pair of panel portions 20 and 22 including corresponding first and second transverse edges 24 and 26 and first and second longitudinal edges 28 and 30, the edges 28 and 30 being integrally joined by the fold zone 18.

A flap 32 extends along one of the first edges 28, across the edges 26 and back along the other edge 28 and supports a zipper-type slide fastener 34 extending therealong whereby the outer panel 12 may be secured in position defining a bag-type receptacle for receiving a human body therein. In addition, the flap 32 also includes a second zipper-type slide fastener 36 extending therealong and marginal edges of the outer panel 12 to which the flap 32 is secured further includes a hook pile strip 38 extending therealong.

The second or intermediate panel 14 includes marginal edges 40 and 42 corresponding to the edges 28 and 26 and along which a loop pile strip 44 extends which may be removably engaged with the strip 38 in order to secure the panel 14 to the panel 12. In addition, panel 16 includes marginal edges 46 and 48 corresponding to the marginal edges 26 and 28 and along which a zipper-type slide fastener 50 extends.

Figure 5:
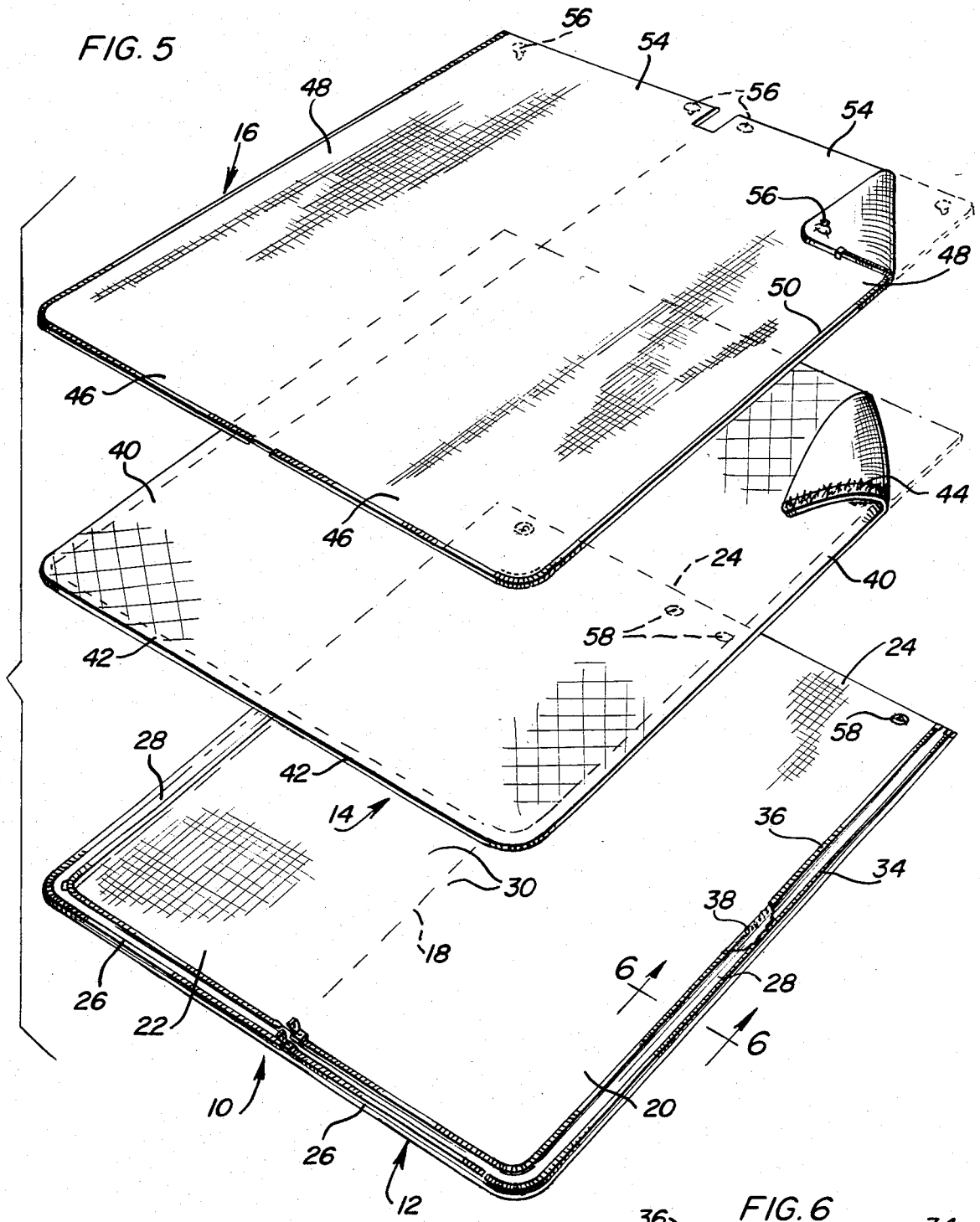
FIG. 5 is an exploded perspective view of the three inner, intermediate and outer panels of the sleeping bag.
Figure 6:
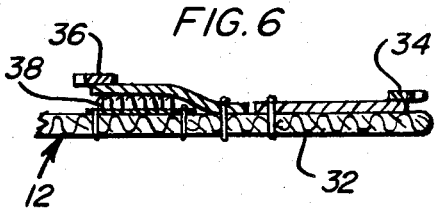
FIG. 6 is a fragmentary enlarged vertical sectional view taken substantially upon the plane indicated by the section line 6—6 of FIG. 5.

The second intermediate panel 14 comprises an insulative panel including any suitable form of insulation material and may be secured over the upper surface of the panel 12 illustrated in FIG. 5 merely by pressing the strips 38 and 44 together. Then, the third inner panel 16 may be placed over the upper surface of the intermediate panel 14 illustrated in FIG. 5 and the slide fastener 50 may be utilized to secure the third panel 16 to the first panel 12, the zipper 50 coating with the zipper 36.

Thereafter, the three panels 12, 14 and 16 may be folded along the zone 18 and the zipper 34 may be used to join the edges 28 together and the edges 26 together completing the open ended bag-type receptacle for receiving a human body therein.

Figure 4:
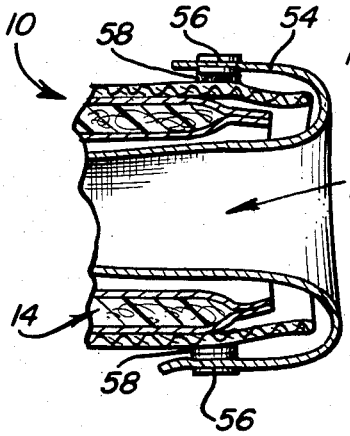
FIG. 4 is a fragmentary enlarged sectional view taken substantially upon the plane indicated by the section line 4—4 of FIG. 1.

However, the length of the third inner panel 16 is somewhat greater than the length of the first and second panels 12 and 14 and the panel 16 include flap end portions 54 which project outwardly beyond the edges 24 of the first outer panel 12 and are foldable thereover. The flap end portions 54 include snap fastener elements 56 supported therefrom which coact with snap fastener elements 58 carried by the edge 24 of the panel 12. In this manner, the flap end portions 54 may be secured in overlying relation relative to the outer surfaces of the panel 12 which define the open end of the sleeping bag 10, see FIGS. 1 and 4.

Figure 3:
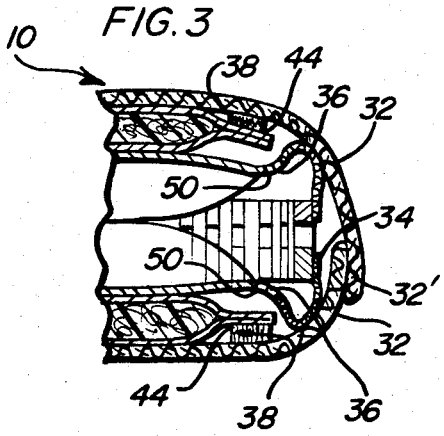
FIG. 3 is a fragmentary enlarged transverse sectional view taken substantially upon the plane indicated by the section line 3—3 of FIG. 1.

Attention is also invited to FIG. 3 wherein it will be seen that one of the mating portions of the flap 32 includes a flap extension 32' whereby the extension 32' may overlap the opposing flap 32.

In operation, the sleeping bag 10 may be assembled in the aforementioned manner and as illustrated in FIG. 1 of the drawings. In this configuration, the sleeping bag may be used as a conventional sleeping bag, except that the inner sheet-forming panel 16 thereof may be removed for laundering. In addition, the panels 12 and 14 are separable whereby either panel 12 or 14 may be replaced or substituted for by a similar panel of slightly different construction.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A flexible sleeping bag of the type including a first outer panel foldable upon itself to form opposing panel portions, each of said panel portions defining first and second transverse edges and first and second longitudinal edges, said second longitudinal edges being integrally joined by the portion of said panel to be folded, elongated inner and outer flaps extending along said second transverse edges and said first longitudinal edges, the outer flap being equipped with first slide fastening means, for removably joining said second transverse edges and said first longitudinal edges, a second intermediate insulation panel of generally the same size and shape as, but slightly smaller than, said outer panel and overlying the latter, coacting strip fastener means extending along said first longitudinal edges and said second transverse edges as well as the corresponding edges of said insulation panel removably joining said insulation panel to said outer panel, and a third inner sheet panel of generally the same size and shape, but slightly smaller than said first panel, said inner flap and the corresponding edges of said third inner panel including coacting second slide fastener means extending therealong inwardly of said first slide fastener means removably joining said third panel to said inner flap of the first panel, said strip fastener means being anchored to said first longitudinal edges and said second transverse edges substantially beneath said inner flap.

2. The sleeping bag of claim 1 wherein said third panel is of a greater length between the first and second transverse edges thereof and defines, at the first transverse edges thereof, outwardly projecting flap means foldable outwardly over the side of the first transverse edges of said first panel remote from said second panel.

3. The sleeping bag of claim 2 including fastener means carried by the free marginal portions of said flap means and said first panel removably securing said flap means in position overlying said first transverse edges of said first panel.

4. The sleeping bag of claim 2 including fastener means carried by the free marginal portions of said flap means and said first panel removably securing said flap means in position overlying said first transverse edges of said first panel, said fastener means including snap fastener means.

5. The sleeping bag of claim 4 wherein said slide fastener means includes a zipper.

6. The sleeping bag of claim 5 wherein said strip fastener means includes coacting loop and hook pile strips.

7. The sleeping bag of claim 6 wherein said third sheet panel is constructed of bedding sheet material.

8. The sleeping bag of claim 1 wherein said slide fastener means includes a zipper.

9. The sleeping bag of claim 4 wherein said strip fastener means includes coacting loop and hook pile strips.

* * * * *